US006666443B2

(12) United States Patent
Shida et al.

(10) Patent No.: US 6,666,443 B2
(45) Date of Patent: Dec. 23, 2003

(54) SHEET FINISHER HAVING STAPLER AND IMAGE FORMING APPARATUS FOR USE THEREWITH

(75) Inventors: Toshio Shida, Higashiyamato (JP); Hiroyuki Wakabayashi, Hino (JP); Tsuyoshi Tsuchiya, Hachioji (JP); Mikihiro Yamakawa, Tokorozawa (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/216,041

(22) Filed: Aug. 8, 2002

(65) Prior Publication Data

US 2003/0034604 A1 Feb. 20, 2003

(30) Foreign Application Priority Data

Aug. 16, 2001 (JP) ..... 2001-247090

(51) Int. Cl.[7] ..... B65H 37/04

(52) U.S. Cl. ..... 270/58.11; 270/58.14; 270/58.12; 270/58.16; 270/58.01; 271/902; 271/184; 271/186; 399/410

(58) Field of Search ..... 270/58.08, 58.09, 270/58.11, 58.12, 58.14, 58.16, 58.17; 271/902, 184, 185, 186, 225; 399/410; 414/796.2, 796.3

(56) References Cited

U.S. PATENT DOCUMENTS 5,112,034 A * 5/1992 Uto et al. ..... 270/58.12
5,303,017 A * 4/1994 Smith ..... 399/403
5,765,824 A * 6/1998 Kawano et al. ..... 270/58.11
5,951,004 A * 9/1999 Hadfy-Kovacs et al. .... 271/184
6,171,225 B1 * 1/2001 Nonoyama et al. ..... 493/16
6,315,288 B1 * 11/2001 Sugishima et al. ..... 271/303
6,332,606 B1 * 12/2001 Seki ..... 270/59
6,471,429 B1 * 10/2002 Isobe et al. ..... 400/582
6,599,226 B2 * 7/2003 Asai et al. ..... 493/321

FOREIGN PATENT DOCUMENTS

JP 09202507 A * 8/1997 ..... B65H/29/58

* cited by examiner

*Primary Examiner*—Patrick Mackey
(74) *Attorney, Agent, or Firm*—Squire, Sanders & Dempsey, L.L.P.

(57) ABSTRACT

In a sheet finisher having a stacker for sheets conveyed from an image forming apparatus and a stapler for stacked sheets, the sheet finisher further has a conveying timing adjustment section arranged upstream of the stacker including: a conveying-in section for a sheet from the image forming apparatus; a conveying-out section separately provided from the conveying-in section; and a reversal conveying section for reversing a conveying direction of the sheet conveyed in one direction from the conveying-in section and for conveying-out from the conveying-out section. A controller controls the reversal conveying section such that at least a second bundle or a bundle after the second bundle of sheet bundles to be stapled by the stapler, in which a plurality of sheets having at least a top sheet and a succeeding sheet to the top sheet are overlapped each other, is conveyed-out from the reversal conveying section.

9 Claims, 12 Drawing Sheets

SHEET FINISHER HAVING STAPLER AND IMAGE FORMING APPARATUS FOR USE THEREWITH

BACKGROUND OF THE INVENTION

The present invention relates to a sheet finisher having a stapler to conduct a staple processing on sheets after the image formation, and an image forming apparatus having the sheet finisher.

The finisher in which, after the image formation is conducted on the sheet, a bundle of a plurality of sheets is stapled, is fitted to the image forming apparatus as a standard function of the high speed image forming apparatus by which an image is formed by the electro-photographic method.

A stapler generally composed of a stacking means for stacking the sheets conveyed in the finisher one by one sheet after the image formation, by the preset number of sheets, and a stapling means for stapling the stacked sheets by staples. In the continuous image forming process, the image formed sheet conveyed-in from the image forming apparatus main body is conveyed in the sheet finisher at a predetermined sheet interval. In the stapler, however, it is necessary that a comparatively long sheet interval is taken between the bundles of the sheets to be stapled, and because the sheet interval between the sheet bundles is longer than the sheet interval between the sheets to be conveyed in, it is necessary to have an adjustment between the conveying control of the sheet in the image forming apparatus main body and the conveying control in the sheet finisher.

As the image formation speed is increased, the mismatching as described above between the sheet interval of the sheet to be conveyed-in from the image forming apparatus main body and the sheet interval of the sheet which can be received by the stapler becomes a problem, thereby a case in which the high speed performance of the image forming apparatus main body is sacrificed to some extent and the productivity of the image formation is necessarily lowered, is generated.

As a countermeasure for such a problem, in Japanese Tokkaihei No. 1-127556, a sheet finisher in which conveying paths of two long and short system are provided upstream the stacking means and the top sheet after the second bundle of the sheet bundles to be stapled, is conveyed in the stacking means through the long conveying path, and the other sheets are conveyed in the stacking means through the short conveying path, is proposed.

Further, in Japanese Tokkaihei No. 9-235069, a sheet finisher in which a sheet stand-by section for making standby two sheets is provided, is proposed.

In the sheet finisher in Japanese Tokkaihei No. 1-127556, because the exclusive use long conveying path for delaying the conveying timing to the stacking means is provided, there is a problem that the image forming speed is high speed, and as the difference between the conveying-in speed of the sheet from the image forming apparatus and the processing speed of the stapler is increased, the length of the conveying path is increased, and the apparatus size is increased. Further, when the long conveying path is arranged in a small sized finisher, the shape of the conveying path becomes complex, and it is difficult that the stable conveying property is secured. As described above, although the sheet finisher in Japanese Tokkaihei No. 1-127556 aims the high speed image formation, the problem becomes conspicuous in the high speed area.

In the sheet finisher in the Japanese Tokkaihei No. 9-235069, because the stand by section for the sheet is provided in the conveying path by which the sheet is conveyed in the stacking means, it is required that the conveying path has both conveying function and accommodation function together, and there is a problem that, for the sheets ranging from the large size to the small size, it is difficult that these requirements are satisfied.

SUMMARY OF THE INVENTION

An object of the present invention is to solve the above described problem relating to the mismatching between the image forming speed of the image forming apparatus main body and the processing speed of the stapler.

The object of the present invention is attained by any one of Structures (1)–(8).

(1) A sheet finisher which has a stacking means for stacking a sheet conveyed-in from an image forming apparatus and a stapling means for stapling the stacked sheets, the sheet finisher is characterized in that: it has a conveying timing adjustment section arranged upstream of the stacking means, and the conveying timing adjustment section has; a conveying-in section; a conveying-out section separately provided from the conveying-in section; a reversal conveying section to reverse the conveying direction of the sheet conveyed from the conveying-in section in one direction and to convey-out it from the conveying-out section; and a control means for conducting the control of the reversal conveying section, wherein the control means controls the reversal conveying section such that at least a second bundle or a bundle after the second bundle of the sheet bundles to be stapled by the stapler, in which a plurality f sheets having at least a top sheet and a succeeding sheet to the top sheet are overlapped each other, is conveyed-out from the reversal conveying section.

(2) A sheet finisher according to the Structure (1), wherein the reversal conveying section has a sheet accommodation section vertically arranged for accommodating the sheet conveyed-in and a stopping member for stopping the sheet conveyed-in, wherein the control means controls the stopping member to send out the sheet to the conveying-out section after stopping the sheet conveyed-in the sheet accommodation section.

(3) A sheet finisher according to either one of the Structure (1) or the Structure (2), wherein the control means controls the reversal conveying section such that the bundle having at least the top sheet and a sheet succeeding to the top sheet which are overlapped each other in the reversal conveying section, and remaining sheets other than the top and the succeeding sheets of said second bundle and sheets of a preceding first bundle is conveyed-out one by one from the reversal conveying section.

(4) A sheet finisher according to any one of the Structures (1)–(3), wherein the reversal conveying section is arranged in the vicinity of the sheet conveying-in inlet of the sheet finisher.

(5) A sheet finisher according to any one of the Structures (1)–(4), wherein the stapling means staples at edge or center position of the sheets.

(6) A sheet finisher according to any one of the Structures (1)–(5), wherein it has an alignment means.

(7) A sheet finisher according to any one of the Structures (1)–(6), wherein it has a folding section.

(8) An image forming apparatus characterized in that: it has the sheet finisher described in any one of Structures (1)–(7), and an image forming apparatus main body by which an image is formed on the sheet and the sheet is conveyed into the sheet finisher.

DETAILED DESCRIPTION OF THE PREFERRED EMBODIMENT (Image Forming Apparatus)

Figure 1:
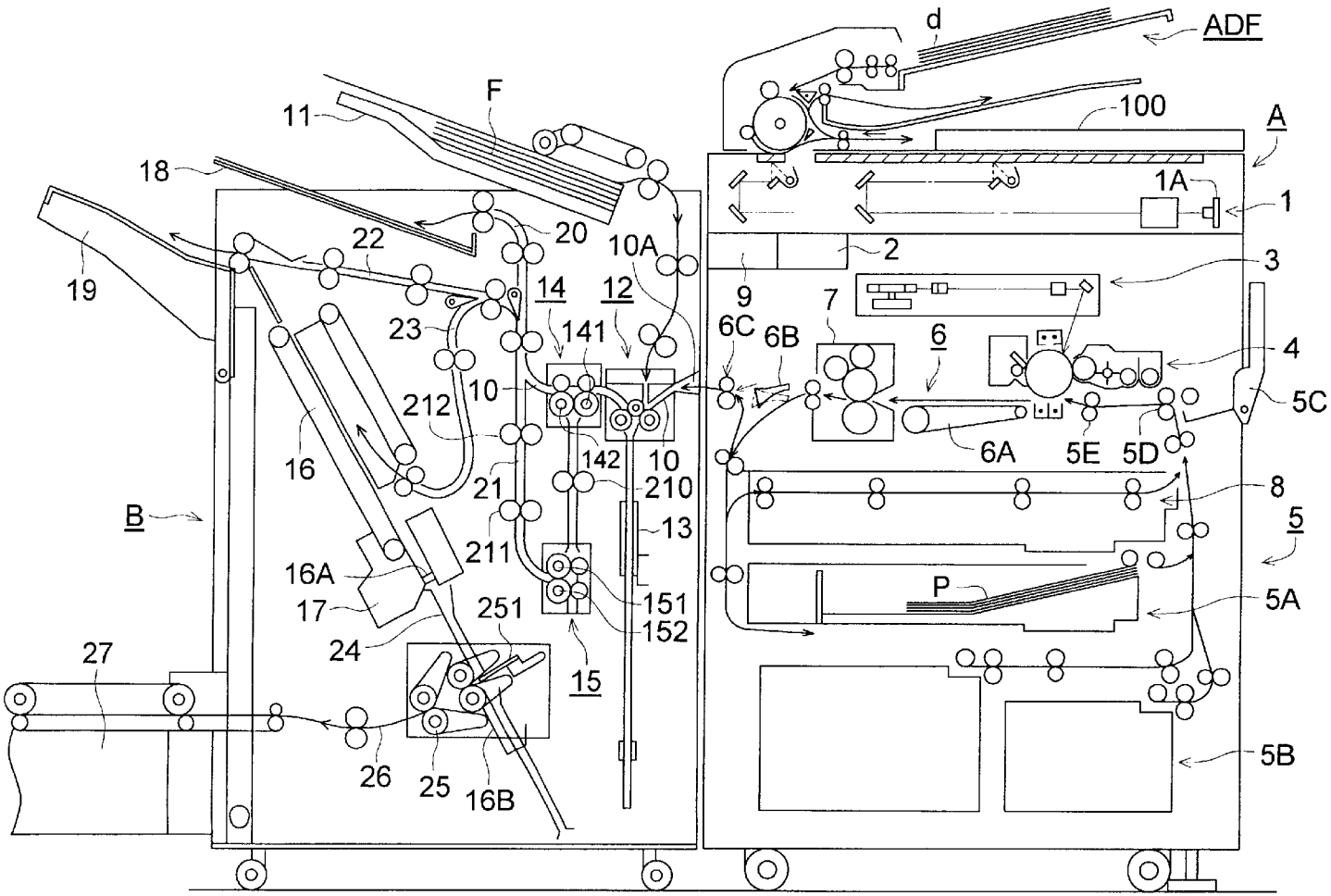
FIG. 1 is a view showing an outline structure of an image forming apparatus according to an embodiment of the present invention.

FIG. 1 is an overall structural view of an image forming apparatus composed of an image forming apparatus main body A, automatic document feeder ADF and sheet finisher B.

The image forming apparatus main body A is provided with an image reading means 1, image processing means 2, image writing means 3, image forming means 4, sheet feeding means S, conveying means 6, fixing means 7, re-conveying means (automatic duplex unit ADU) 8, and control means 9.

The sheet feeding means 5 is composed of a cassette sheet feeding section 5A and large capacity sheet feeding tray (LCT) 5B, manual sheet feeding section 5C, intermediate sheet feeding roller 5D, and register roller 5E.

The conveying means 6 has a conveying belt 6A, conveying path switching plate 6B, and sheet delivery roller 6C.

On the upper portion of the image forming apparatus A, the automatic document feeder ADF is mounted. The sheet finisher B is connected to the sheet delivery roller 6C side on the left side surface shown in the drawing of the image forming apparatus min body A.

The document "d" placed on the document table of the automatic document feeder ADF is conveyed in the arrowed direction, and an image of a single side or double sides of the document is read by an optical system of the image reading means 1, and read in a CCD image sensor 1A.

An analog signal which is photo-electrically converted by the CCD image sensor 1A is sent to the image writing means 3, after analog processed, A/D converted, shading corrected, and image compression processed in the image processing means 2.

In the image writing means 3, output light from a semiconductor laser is radiated onto a photoreceptor drum of the image forming mean 4 and a latent image is formed. In the image forming means 4, processing such as charging, exposing, developing, transferring, separation, and cleaning, is conducted. Onto the sheet S sent from the sheet feeding means 5, an image is transferred in a transfer section.

The sheet S on which the image is carried, is conveyed by a conveying belt 6A, fixed by a fixing means 7, and sent from a sheet delivery roller 6C into a sheet introduction section 10A of the sheet finisher B. Or by the conveying path switching plate 6B, the sheet S whose one side is image processed, which is sent into a re-conveying means 8, is, in the image forming means 4 again, after the double-side image processing, delivered from the sheet delivery roller 6C. The sheet S delivered from the sheet delivery roller 6C, is sent into the sheet finisher B.

The sheet finisher B has: the sheet introduction section 10A by which the sheet P on which the image is formed is received; sheet feed apparatus 11 to feed an additional sheet F; branching section 12; reversal conveying section 13, folding sections 14, 15; intermediate tray 16; stapling section 17; fixed sheet delivery tray 18; elevation sheet delivery tray 19 which can move upward and downward; center folding section 25; and fixed sheet delivery section 27, and those are connected by the conveying paths 10, 20, 21, 22, and 23.

The sheet finisher B conducts finishing in the following process modes.

(1). Simple Sheet Delivery Mode

The sheet P introduced from the sheet introduction section 10A is simple-delivered in the order of introduction. In this mode, the sheet P is delivered onto the fixed sheet delivery tray 18 through the conveying path 10, reversal conveying path 13 and conveying path 20.

(2). Folding Mode

The sheet P is two-folding processed or three-folding processed (for example, Z-folding processed) by which the sheet P is folded at one portion or two-portions, and delivered.

The sheet P introduced from the sheet introduction section 10A is conveyed to the folding sections 14, 15, and after it is folding processed by the folding sections 14 and 15, it is delivered onto the elevation sheet delivery tray 19 through the conveying path 10, and the conveying path 22. There is a case where tree-folding processing is conducted by the folding sections 14 and 15 and a case where two-folding processing is conducted by using only the folding section 14.

(3). Stapling Mode

Stapling processing is conducted for each sheet bundle of a plurality of sheets, and the stapled sheet bundle is delivered.

After the sheet P conveyed from the conveying path 10 to the conveying path 23 is stacked on the intermediate tray 16 as a stacking means by set number of sheets, the sheets are staple processed by the stapling section 17 as a staple processing means, and after staple processing, the sheets are delivered onto the elevation sheet delivery tray 19. In the stapling mode, there is an end stapling mode by which a corner portion of the sheet is stapled or an edge portion is stapled, and a center stapling mode by which the central portion of the sheets is stapled.

(4). A Mode in Which (2) Folding Mode and (3) Stapling Mode are Combined and Processed By conducting the center stapling and center folding, a booklet is made. In the center stapling and center folding modes, after the sheets are staple processed by the stapling section 17, the sheets are center folding processed by the center folding section 25 and the bundle of sheets is delivered on the fixed sheet delivery section 27.

In the above each mode, when an additional sheet F is fed from the sheet feed tray 11, and added to the sheet P which is supplied from the image forming apparatus main body A, the cover, back cover and partition can be added for each bundle of the sheets P.

(Sheet Stapling Process)

After the preset number of sheets P are stacked on the intermediate tray 16 as the stacking means, the alignment in the width direction is conducted by the well known method, and next, the stapling process is conducted by the stapling section 17 as the staple processing means.

There are an edge stapling mode to staple the peripheral portion of the sheets and a center stapling mode which is conducted together with the center folding process. In the case of the edge stapling mode, the sheet P is stopped by the stopping member 16A and adjusted in the conveying direction, and after it is further aligned in the sheet width direction by the alignment means (not shown), it is stapled by the stapling section 17 and a bundle of the stapled sheets is elevated by a sheet push-up member (not shown) and delivered onto an elevation sheet delivery tray 19. In the case of the center stapling, the sheet P is stopped by the stopping member 16B and aligned in the conveying direction, and after it is further aligned in the sheet width direction, it is center-stapled by the stapling section 17 and the center folding processing is conducted on the bundle of the stapled sheets by the center folding section 25, and it is delivered onto the fixed sheet delivery section 27 through the delivery roller 26.

The stapler and the center folding section 25 are known, and they can be conducted by the known arbitrary methods.

(Conveying Timing Adjustment Section)

The conveying timing adjustment section is composed of a branching section 12 and a reversal conveying section 13.

Figure 2:
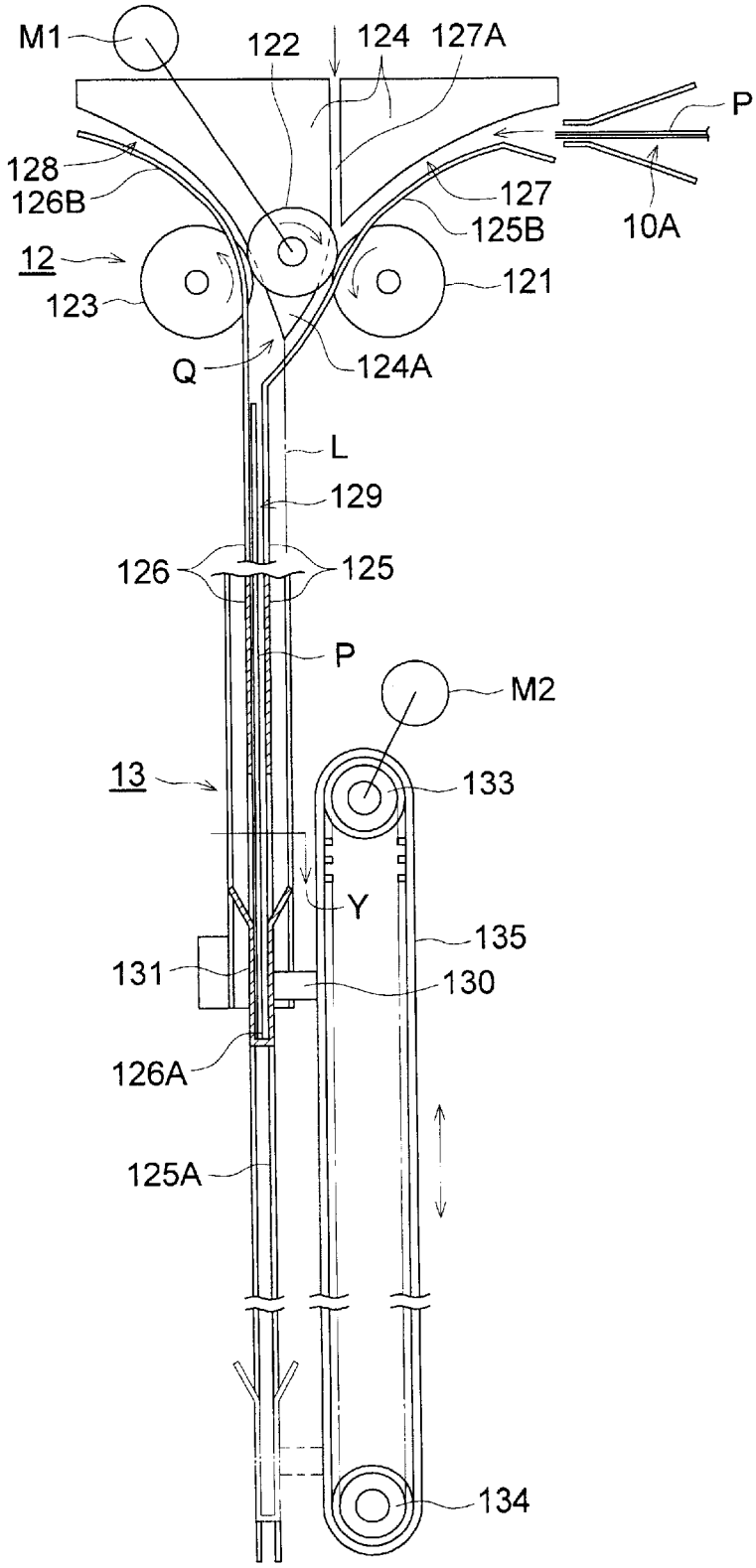
FIG. 2 is a view showing a conveying timing adjustment section in a sheet finisher according to the embodiment of the present invention.

The conveying timing adjustment section will be described by FIG. 2 which is a sectional view of the conveying timing adjustment section.

The branching section 12 conveys the sheet P from the conveying path 10 as the main conveying path into the reversal conveying section 13 and conveys it from the reversal conveying section 13 to the conveying path 10. The branching section 12 is composed of: an upper side guiding member 124; lower side guiding members 125B and 126B; drive roller 122 driven by a stepping motor M1 and follower rollers 121 and 123, and the branching section 12 has a conveying-in path 127 formed of the upper side guiding member 124 and lower side guiding member 125B, and a conveying-out path 128 formed of the upper side guiding member 124 and lower side guiding member 126B.

The conveying-in section is structured by the drive roller 122 as the first drive roller, the follower roller 121 as the first follower roller, and conveying-in path 127, and the conveying-out section is structured by the drive roller 122 as the second drive roller, follower roller 123 as the second drive roller and a conveying-out path 128. A protrusion 124A (also referred to as a branching guide) of the upper side guiding member 124 separates the conveying-in path 127 from the conveying-out path 128.

Vertical portions parallely opposed to each other of guiding plates 125 and 126, structure a sheet accommodation portion having a passage 129, further, an upwardly opened upper portion of the guiding plates 125 and 126 structures the lower side guiding members 125B and 126B, and as described above, forms the conveying-in path 127 and the conveying-out path 128 of the sheet P.

The upper side guiding member 124 has a protrusion 124A as the guiding member on its lower end. The leading edge Q of the protrusion 124A is, as shown by the vertical line L drawn at the leading edge Q, set such that it is positioned on more conveying-in path 127 side than a vertical parallel portion (sheet accommodation section) of the guiding plate 125. By such the shape of the protrusion 124A, the sheet P conveyed-in from the conveying-in path 127 is surely moved from the conveying-in path and guided to the conveying-out path 128, when its upper end portion is separated from the nip between the drive roller 122 and follower roller 121 and drops, and supported by the stopping member 131.

Figure 3:
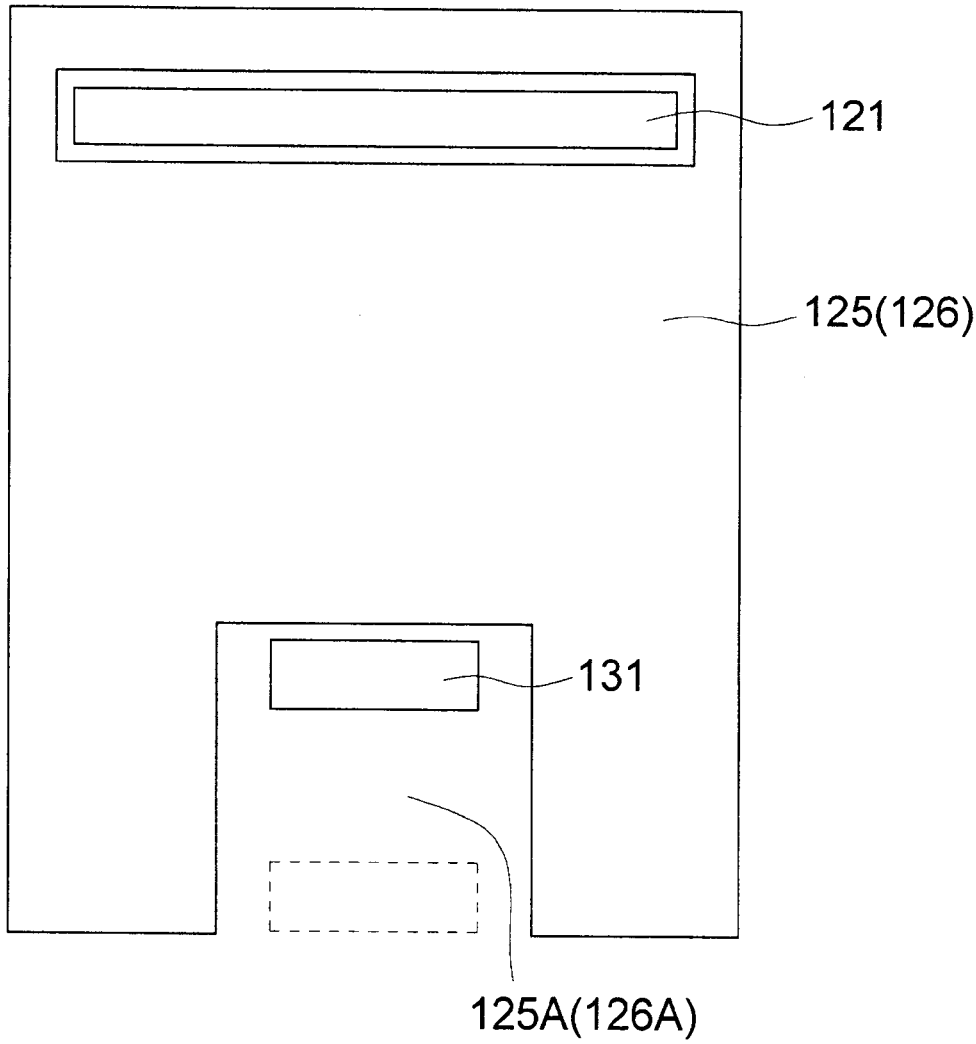
FIG. 3 is a side view of a reversal conveying section.

In the guiding plates 125 and 126, as shown in FIG. 3, cutout portions 125A and 126A are formed at a central portion of the conveying path width direction. As shown in FIG. 3, in a portion of the cutout portions 125A and 126A, as shown in FIG. 2, the stopping member 131 having the upwardly opened introduction portion is provided. The stopping member 131 is connected to a toothed belt 135 by a connection member 130, and moves upward and downward, by being driven by a stepping motor M2. The stopping member 131, as will be described later, positions the first-third positions V1–V3, and the first-third positions V1–V3 are changed corresponding to the sheet size.

(Conveying Control in the Sheet Stapling Process)

Figure 4:
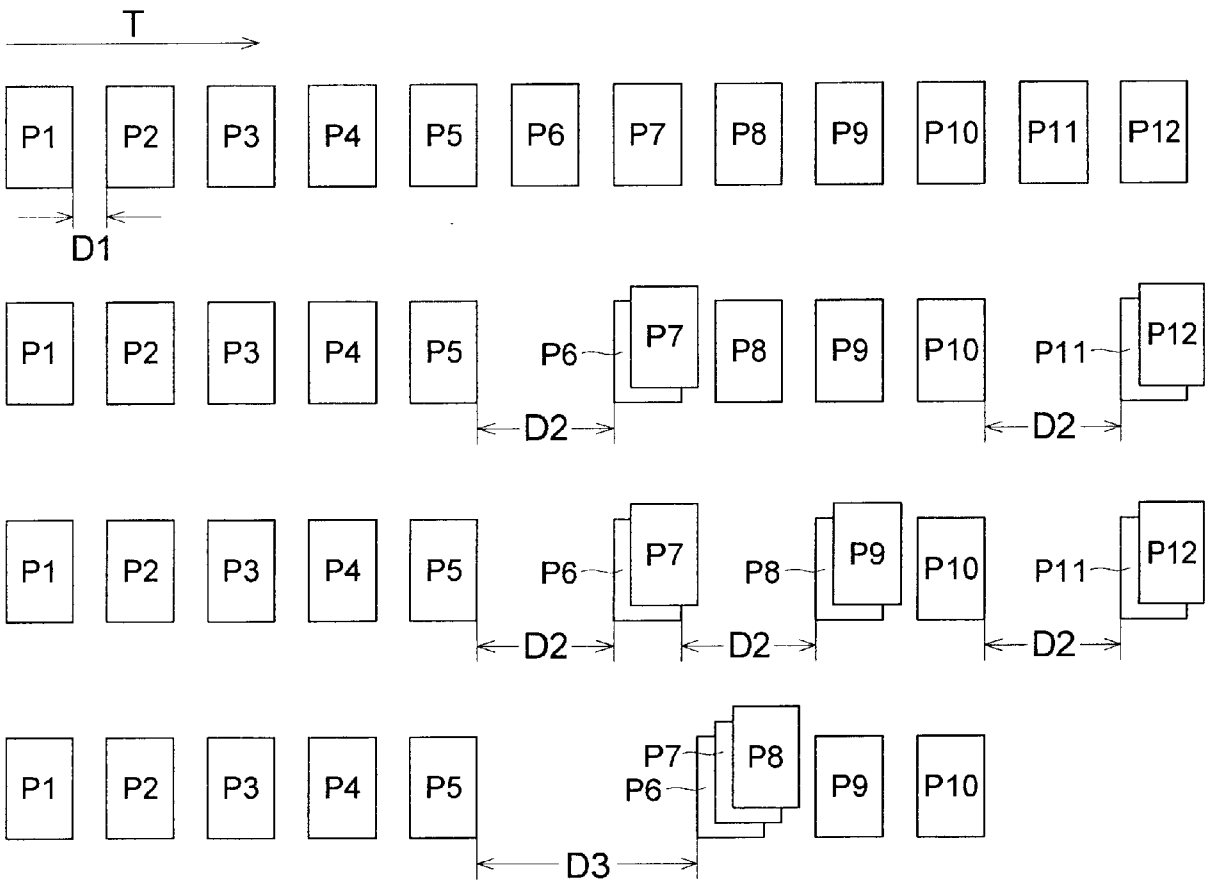
FIGS. 4(*a*)–4(*d*) are views showing the conveying timing of a sheet.

FIGS. 4(*a*)–4(*d*) show the conveying timing of the sheet, and an example in which 5 sheets form one bundle and the stapling processing is conducted on it, is shown. An arrow T in FIGS. 4(*a*)–4(*d*) shows the time.

FIG. 4(*a*) shows the conveying timing of the sheet conveyed-in from the image forming apparatus main body A. From the image forming apparatus main body A, as shown in FIG. 4(*a*), the sheets are continuously delivered at a predetermined short sheet interval D1, and conveyed in the sheet finisher B.

FIG. 4(*b*) is an example in which a bundle is formed of the leading sheet P6 of the bundle of the sheets subsequent to the second bundle and the second sheet P7 succeeding to the leading sheet P6, and by conveying these sheets simultaneously, the sheet interval between bundles of sheets is enlarged as shown by D2.

The sheets P1–P5 forming the first one bundle are conveyed at an equal sheet interval D1 and stacked onto the intermediate tray 16. On the intermediate tray 16, for the time period to conduct the alignment in the sheet width direction and stapling processing, in the conveying into the intermediate tray 16 of the leading sheet P6, it is necessary that the sheet interval to the last sheet P5 of the first sheet bundle is enlarged. In the present embodiment, the wide sheet interval D2 is secured by overlapping the leading sheet P6 of the second sheet bundle with the succeeding second sheet P7. In the same manner, by overlapping the leading sheet P11 of the third sheet bundle with the second sheet P12, the wide sheet interval D2 is secured.

FIG. 4(*c*) is an example in which, by basically simultaneously conveying two sheets as one bundle, the sheet interval is enlarged to the long interval D2, and when the number of sheets of the bundle of the sheets to be stapling processed can be divided by the number of sheets of the bundle of sheets which are overlapping conveyed in the conveying timing adjustment section, the conveying mode in which the all sheets are bundled in the conveying timing adjustment section, can be applied.

FIG. 4(*d*) is an example in which, by simultaneously conveying three sheets as one bundle, the sheet interval is enlarged to further long interval D3.

Figure 5:
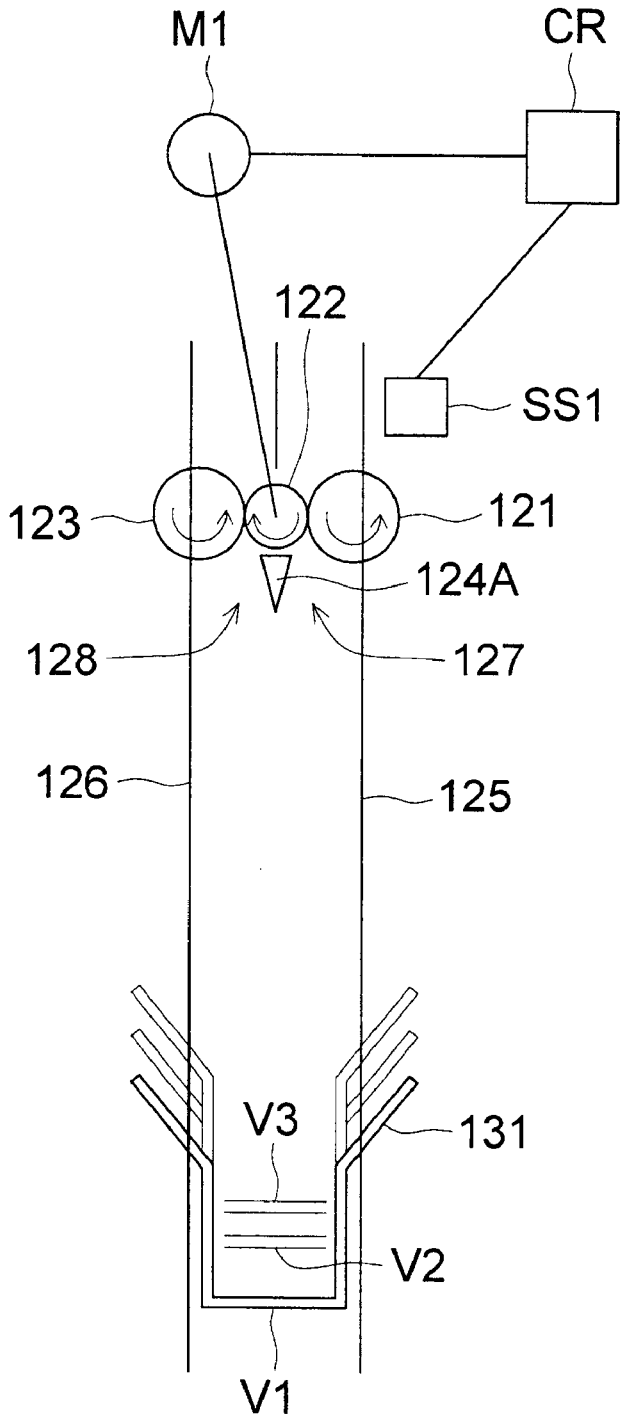
FIG. 5 is a typical view of a conveying timing adjustment section.

Next, referring to FIG. 5 which is a typical view of the timing adjustment section and FIGS. 6–8 which are views showing the conveying process, a normal conveying control to convey the sheets with the short sheet interval D1 will be described.

The conveying timing adjustment section of the sheet finisher according to the present embodiment is provided with the drive roller 122, follower rollers 121 and 123, two parallel guiding plates 125 and 126, protrusion 124A and stopping member 131, as already described above.

The drive roller 122 is rotated clockwise as shown by an arrow, and conveys the sheet into the reversal conveying section, and conveys the sheet from the reversal conveying section.

The guiding plates 125 and 126 accommodate the conveyed-in sheet, and the protrusion 124A guides the sheet at the time of its conveying-in and conveying-out, and the protrusion 124A separates the conveying-in path 127 from the conveying-out path 128, and guides the sheets so that the preceding sheet and the succeeding sheet do not collide with each other.

In the present embodiment, after the sheet is conveyed between the guide plates 125 and 126, the sheet is switched back and conveyed.

Figure 6:
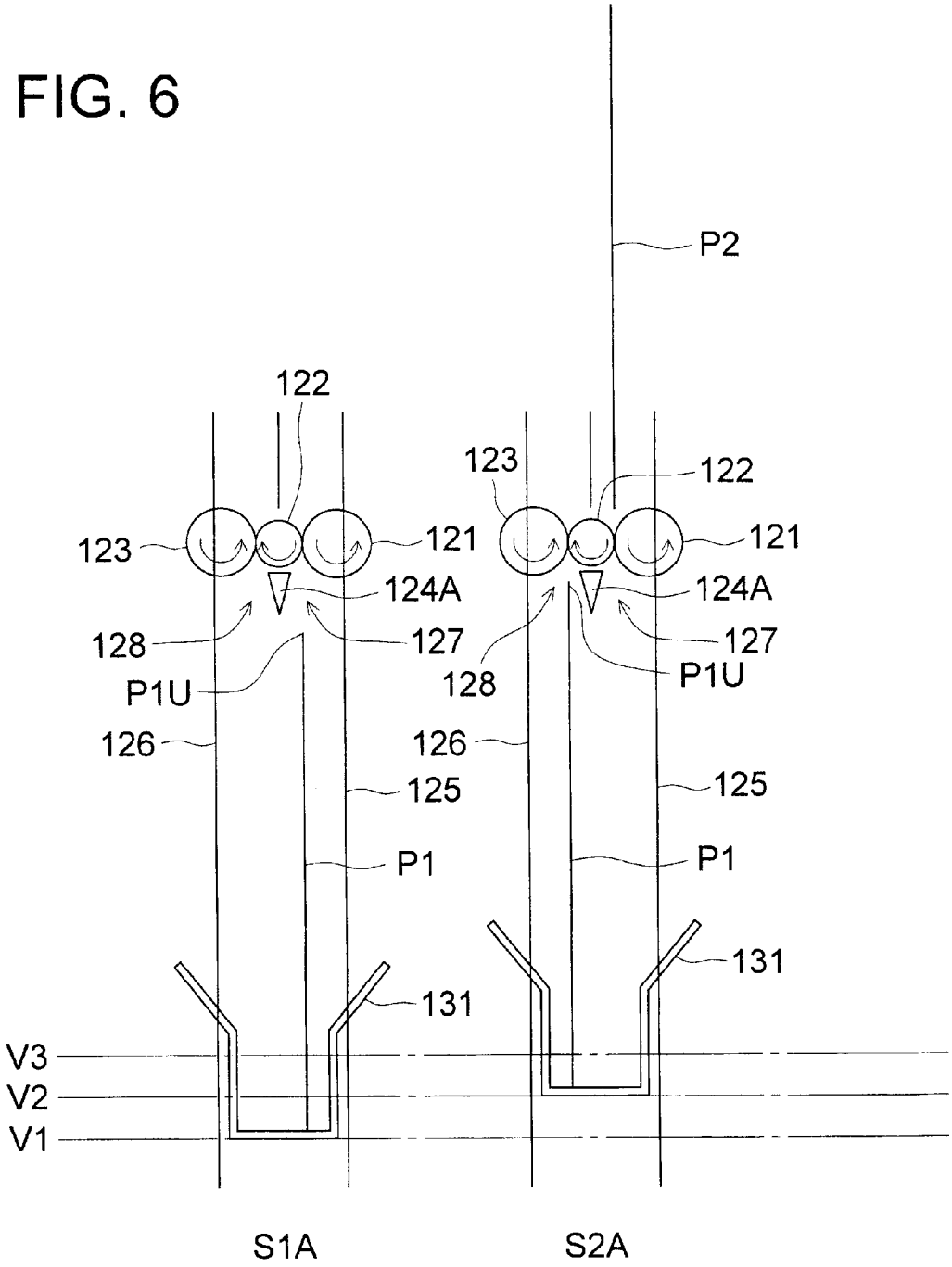
FIG. 6 is a view showing a conveying process forming a short sheet interval.
Figure 7:
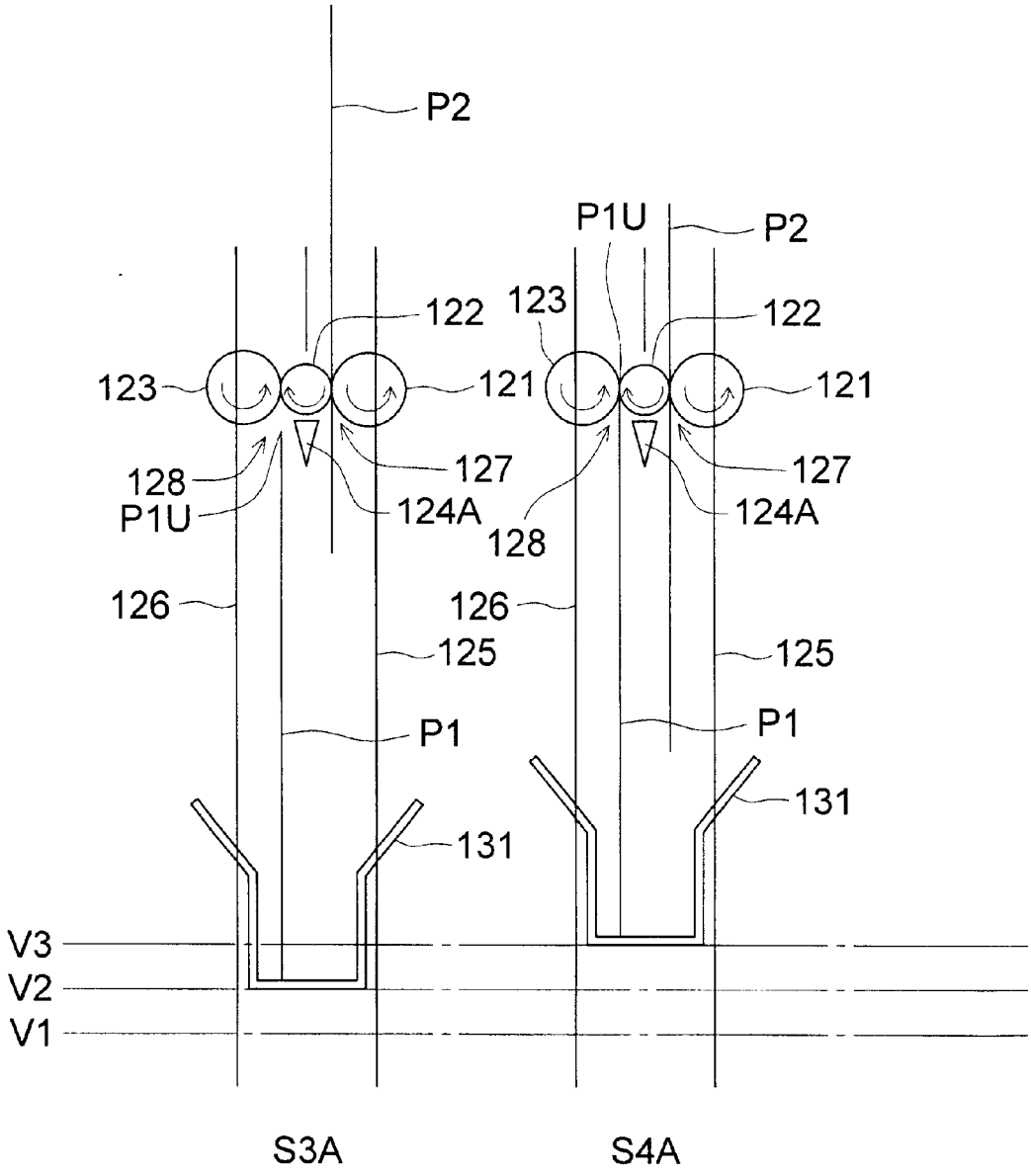
FIG. 7 is a view showing a conveying process forming a short sheet interval.
Figure 8:
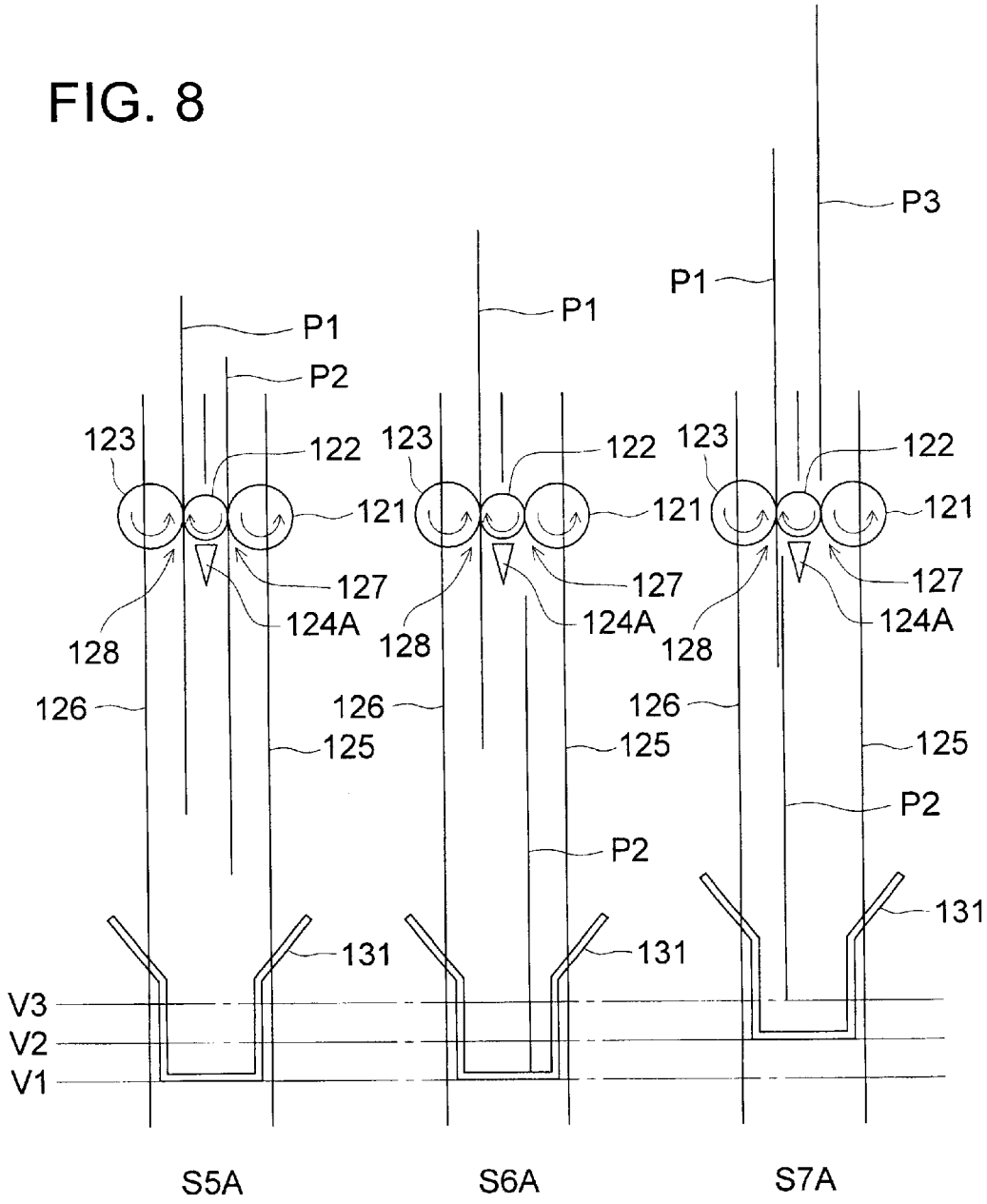
FIG. 8 is a view showing a conveying process forming a short sheet interval.

S1A–S7A in FIGS. 6–8 show the process in which a plurality of sheets are conveyed at a short sheet interval D1.

In the conveying-in stage of the first sheet P1, the sheet P1 is conveyed-in by the drive roller 122 and the follower roller 121, and the sheet P1 is dropped to the stopping member 131. The stopping member 131 is set at the first position V1 at which the upper end (trailing edge in the conveying direction) P1U of the sheet P1 is lower than the lower end (guiding end) of the protrusion 124A. The S1A in FIG. 6 shows the condition that the conveying-in stage is completed and the sheet P1 is supported by the stopping member 131.

In the stage S2A, the stopping member 131 is set at the second position V2 at which the upper end P1U of the sheet P1 is elevated to the upper portion than the lower end (guiding end) of the protrusion 124A. By the elevation to the second position V2 of the stopping member 131 in the stage S2A, the upper end P1U of the sheet P1 is moved from the conveying-in path 127 to the conveying-out path 128.

Such the introduction to the conveying-out path 128 of the upper end P1U of the sheet P1, as described above, is realized by the shape of the conveying-in path 127, protrusion 124A and the conveying-out path 128. Further, by the movement of the protrusion 124A, the upper end P1U can also be introduced to the conveying-out path 128.

The stage S34 is a stage in which the upper end P1U is introduced into the conveying-out path 128, and in this stage, the second sheet P2 is conveyed in by the drive roller 122 and follower roller 121.

In the next stage S4A, the stopping member 131 is elevated, and the upper end P1U (leading edge in the conveying direction) of the preceding first sheet P1 is nipped between the drive roller 122 and the follower roller 123. While the sequence transfers from the stage S3A to stage S4A, the succeeding sheet P2 is conveyed and runs downward between guiding plates 125 and 126 as shown in the drawing.

In the next stage S5A, the stopping member 131 is lowered to the first position V1. During this, the sheet P1 is continuously conveyed, and as shown in the drawing, runs upward, and the sheet P2 runs downward.

The stage S6A is a stage in which the upper end (trailing edge in the conveying direction) of the sheet P2 is separated from the drive roller 122 and the follower roller 121 and drops, and it is supported by the stopping member 131, and the stage is equal to the stage S1A.

Next, the third sheet P3 is conveyed in. In the stage S7A in which the conveying-in of the sheet P3 is started, 3 sheets P1, P2 and P3 simultaneously run in the reversal conveying section, that is, on a passage between the guiding plates 125 and 126, as shown in the drawing.

Figure 9:
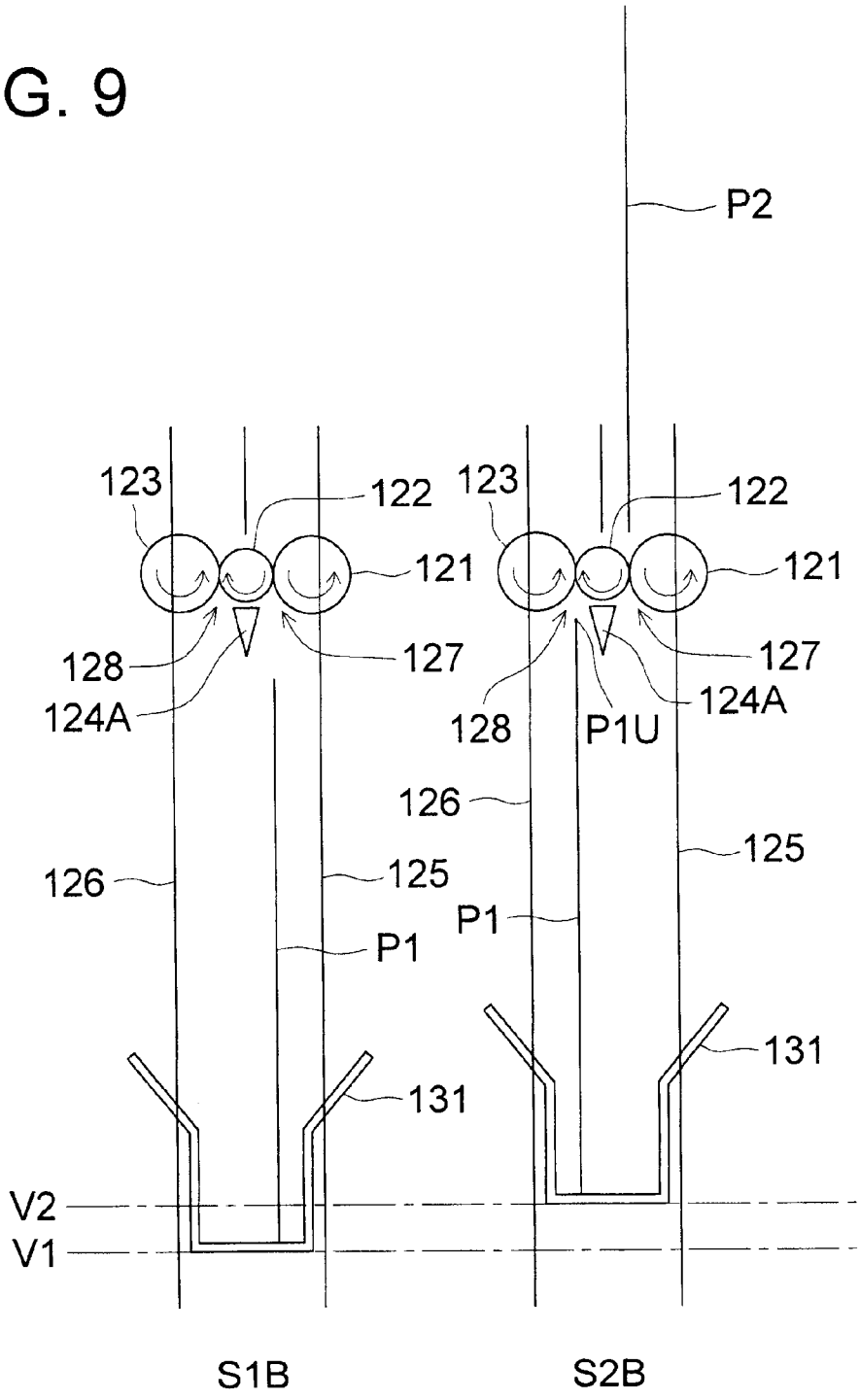
FIG. 9 is a view showing a conveying process forming a long sheet interval.
Figure 10:
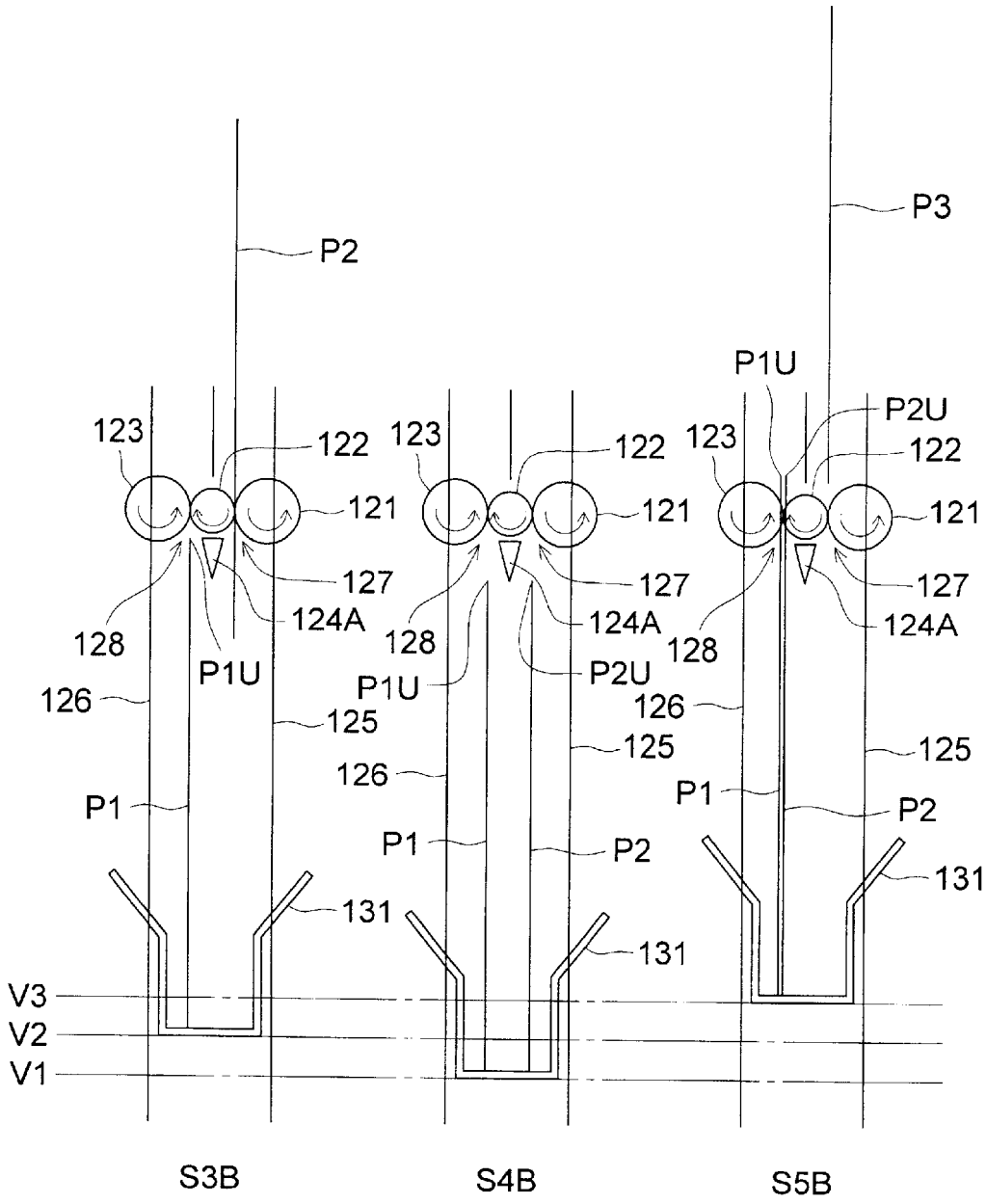
FIG. 10 is a view showing a conveying process forming a long sheet interval.

Next, the conveying control to form the long sheet interval D2 will be described by FIGS. 9 and 10 showing the conveying process.

In the conveying-in stage S1B of the first sheet P1, the sheet P1 is conveyed in by the drive roller 122 and the follower roller 121, and the sheet P1 is dropped to the stopping member 131. The stopping member 131 is set at the first position V1 at which the upper end (trailing edge in the conveying-in direction) P1U of the sheet P1 is lower than the lower end (guiding end) of the protrusion 124A.

In the stage S2B, the stopping member 131 is set at the second position V2 at which the upper end P1U of the sheet P1 is elevated to the upper portion than the lower end (guiding end) of the protrusion 124A. By the elevation to the second position V2 of the stopping member 131 in the stage S2B, the upper end P1U of the sheet P1 is withdrawn from the conveying-in path 127 to the conveying-out path 128.

The stage S3B is a stage in which the second sheet P2 is conveyed in. The conveying-in of the second sheet P2 is conducted under the condition that the upper end (trailing edge in the conveying-in direction) P1U of the first sheet P1 is moved from the conveying-in path 127 to the conveying-out path 128.

The stopping member 131 is lowered to the first position V1 from the stage of S3B, and transfers to the next stage S4B. In the stage S4B, the second sheet P2 is separated from the nip between the drive roller 122 and the follower roller 121, and it drops and stops on the stopping member 131.

In the next stage S5B, the stopping member 131 is elevated to the third position V3, and the upper end (leading edge in the conveying-out direction) P1U of the first sheet P1 and the upper end (leading edge in the conveying-out direction) P2U are made to reach the nip between the drive roller 122 and the follower roller 123. Then, by the rotation of the drive roller 122, two sheets P1 and P2 are simultaneously conveyed and conveyed-out to the conveying path 10.

By repeating the stages S1B–S5B, because the conveying timing of the first sheet P1 is delayed by one sheet, and the bundle of two sheets P1 and P2 is simultaneously conveyed-out on the conveying path 10, the sheet interval D2 is secured.

By combining the conveying control shown in FIGS. 6–8, and the conveying control shown in FIGS. 9 and 10, the conveying in which the sheet intervals D1 and D2 shown in FIGS. 4(*b*) and 4(*c*) mixedly exist can be conducted. Further, by repeating the conveying process composed of the stage S2B and S3B after the stage S4B, the number of sheets of the bundle of the sheets conveyed-out from the reversal conveying section 13 can be made larger than 3, and the sheet interval D3 shown in FIG. 4(*d*) can be secured.

In the conveying control described by FIGS. 6–10, the drive roller 122 driven by the stepping motor M1 is continuously rotated in one direction and the conveying-in to the reversal conveying section 13 and conveying-out from the reversal conveying section 13 of the sheet are conducted. The stepping motor M2 to control the position of the stopping member 131 conducts the displacement control of the stopping member 131 between the first-the third position during a predetermined time period set from of the output of the sheet leading edge detection signal, according to the sheet leading edge detection signal of the sensor SS1 provided just upstream the conveying section, and these controls are conducted by the control means CR.

(Folding Process)

Figure 11:
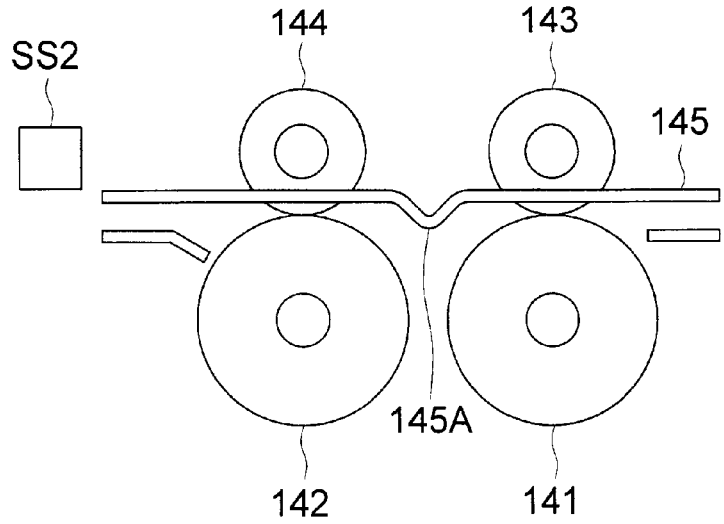
FIGS. 11(*a*) and 11(*b*) are views showing the structure of a folding section.
Figure 11:
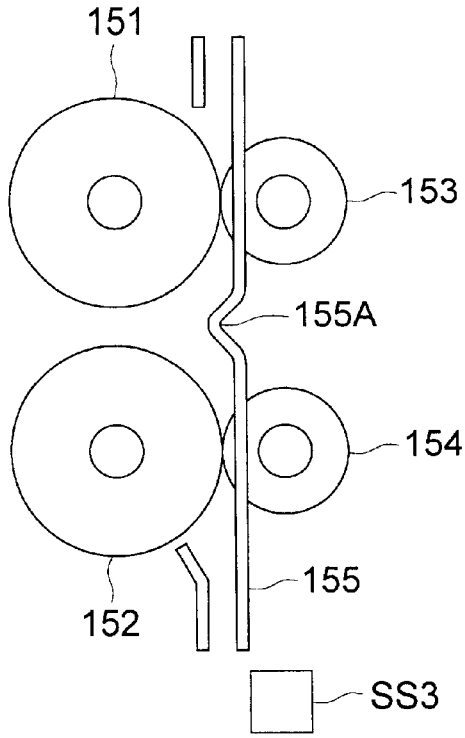
Figure 12:
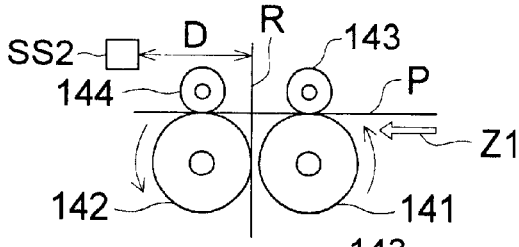
FIGS. 12(*a*)–12(*f*) are views showing a folding process.
Figure 12:
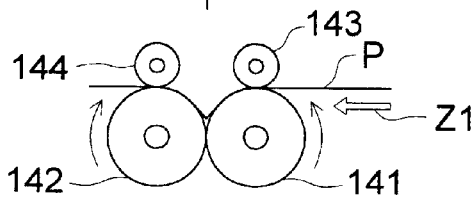
Figure 12:
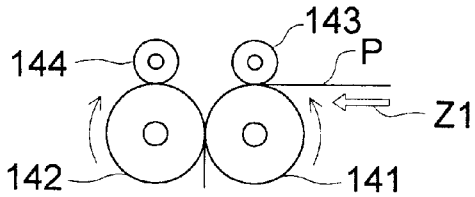
Figure 12:
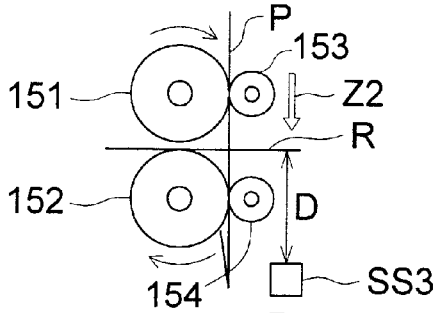
Figure 12:
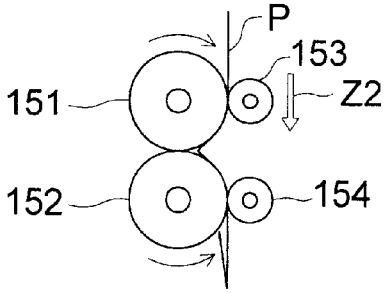
Figure 12:
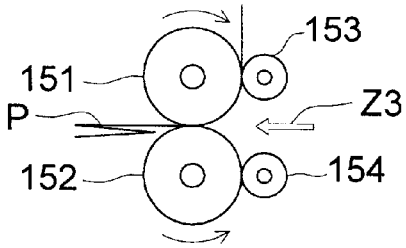

FIGS. 11(*a*), 11(*b*) show the structure of the folding sections 14 and 15, and FIGS. 12(*a*)–12(*f*) show the three-folding process (Z-folding process) in which the sheet P is folded at 2 portions.

The folding section 14 shown in FIG. 11(*a*) is structured by folding rollers 141, 142 as the drive roller, follower rollers 143, 144 which are driven respectively in contact with these folding rollers, and guiding member 145. The folding roller 141 can be displaced as will be described later.

The folding section 15 shown in FIG. 11(*b*) is structured by folding rollers 151, 152 as the drive roller, follower rollers 153 and 154 which are driven respectively in contact with these folding rollers, and guiding member 155. The folding roller 151 can be displaced as will be described later.

In the folding mode, for example, the first folding processing is conducted on the sheet P at ¼ position from the leading edge by the folding section 14, and further, the folding processing is conducted at ¼ position (¼ sheet entire length) from the leading edge of the folded sheet P by the folding section 15, and the sheet P is, for example, Z-folding processed.

In FIG. 12(*a*), under the condition that the folding roller 141 and the folding roller 142 are separated from each other, and follower rollers 143 and 144 are respectively in pressure-contact with the folding rollers 141 and 142, the sheet P is conveyed and introduced into the folding section 14. In the stage in which the sheet P is conveyed from the reference position R by a predetermined distance D, by the sheet leading edge detection signal of the sensor SS2, the drive of the folding rollers 141 and 142 is stopped, and the sequence transfers to the folding process in FIG. 12(*b*).

In FIG. 12(*b*), the folding roller 141 and the follower roller 143 are displaced, and after the folding roller 141 and the folding roller 142 are come into pressure-contact with each other, the folding roller 141 is rotated in the same direction as that at the time of the introduction, and the folding roller 142 is rotated in the opposite direction to that at the time of the introduction and the folding processing is started. By the conveying operation of the folding rollers 141 and 142 in the opposite direction onto the sheet P, the sheet P is bent and the fold of the sheet P enters between the folding roller 141 and the folding roller 142. In this connection, a guiding member 145 having the protrusion 145A by which the bent of the sheet P to the folding rollers 141 and 142 side is surely conducted, is provided. Further, as shown in FIG. 12(*c*), the folding is conducted by continuously rotating the folding rollers 141 and 142, and the folded sheet P is conveyed by the conveying roller 210, and introduced into the folding section 15.

As shown in FIG. 12(*d*), the folding rollers 151 and 152 of the folding section 15 are separated, and under the condition that the follower roller 153 and the follower roller 154 are respectively in pressure-contact with the folding rollers 151 and 152, the sheet P is introduced, and in the stage in which the leading edge of the folded sheet is conveyed from the reference position R by a predetermined distance D, according to the sheet leading edge detection signal of the sensor SS3, the folding roller 151 is displaced, and is made in pressure-contact with the folding roller 152. After the pressure-contact, the folding roller 151 is rotated in the same direction as that at the time of the introduction and the folding roller 152 is rotated in the opposite direction to that at the time of the introduction. By the conveying operation of the folding roller 151 and 152 in the opposite direction onto the sheet P, the sheet P is bent and the fold of the sheet P enters between the folding roller 151 and the folding roller 152. In this connection, a guiding member 155 having the protrusion 155A by which the bending of the sheet P to the folding rollers 151 and 152 side is surely conducted, is provided. As shown in FIG. 12(*e*), after the pressure-contact, the rotation direction of the folding roller 152 is reversed, and the sheet P is folded. As shown in FIG. 12(*f*), the rotation of the folding rollers 151 and 152 are continued, and while the sheet P is folded, the sheet P is delivered from the folding section 15 and conveyed to the conveying path 10.

In the example of FIGS. 12(*a*)–12(*f*), the folding is conducted at the position of ¼ from the leading edge of the sheet P. The sensor SS2 and SS3 respectively detect the leading edge of the sheet P at the reference position, that is, at D=¼×LT (LT is the length in the conveying direction of the sheet P) from the position shown by the tangential line of the outer periphery of folding rollers 141 and 142 and the position shown by the tangential line of the outer periphery of folding rollers 151 and 152. Actually, the delay of the reversing time of the folding rollers 141, 142, 151, and 152 is considered, and the position is set to a little shorter distance than ¼×LT.

The sensors SS2 and SS3 are set at various positions depending on the folding mode in the sheet P or sheet size.

As shown in the drawing, in the process in which the folding processing is conducted at two portions in the sheet P, the sheet P is introduced into the folding section 14 from the direction Z1, and conveyed and sent in the direction Z2 almost perpendicular to the direction Z1 from the folding section 14 into the folding section 15. The sheet P folding processed in the folding section is conveyed in the direction Z3 almost perpendicular to the direction Z2, that is, in the almost same direction Z3 as the direction Z1.

According to the Structure (1), (3), (5), or (6), because, in the reversal conveying section, a plurality of sheets are overlapped and a bundle of the sheets is formed and conveyed, thereby the sheet interval is enlarged, the sheet interval necessary for the staple processing can be obtained enough, and can cope with the high speed image formation in the image forming apparatus main body, and the stable conveying can be conducted corresponding to the sheet size of the wide range from the small size to the large size. As the result, the high speed processing can be conducted. Further, because the high speed processing is possible, the conveying line speed is lowered and the processing can be conducted, and the high stable and reliable sheet finisher is realized.

According to the Structure (2), a sheet bend in the conveying direction is effectively corrected, and the size reduction is possible, and the sheet finisher having the high speed and high stability is realized.

According to the Structure (4), (5) or (7), because the sheet is conveyed to the finish processing section by which each kind of finish processing is conducted on the sheet interval adjusted sheet, each kind of finish processing can be stably conducted.

According to the Structure (8), the image forming apparatus by which the finish processing can be stably conducted even when the image forming apparatus main body is made high speed, is realized.

What is claimed is:

1. A sheet finisher comprising:

(a) a stacker for stacking sheets conveyed-in one by one from an image forming apparatus;

(b) a stapler for stapling stacked sheets; and (c) a conveying timing adjustment section arranged upstream of the stacker, comprising:

(1) a conveying-in section for conveying-in a sheet from the image forming apparatus;

(2) a conveying-out section separately provided from the conveying-in section for conveying-out the sheet;

(3) a reversal conveying section for reversing a conveying direction of the sheet conveyed in one direction from the conveying-in section and for conveying-out from the conveying-out section; and (4) a controller for controlling the reversal conveying section, wherein the controller controls the reversal conveying section such that at least a second bundle or a bundle after the second bundle of sheet bundles to be stapled by the stapler, in which a plurality of sheets having at least a top sheet and a succeeding sheet to the top sheet are overlapped each other, is conveyed-out from the reversal conveying section.

2. The sheet finisher of claim 1, wherein the reversal conveying section has a sheet accommodation section vertically arranged for accommodating the sheet conveyed-in and a stopping member for stopping the sheet conveyed-in, wherein the controller controls the stopping member to send out the sheet to the conveying-out section after stopping the sheet conveyed-in the sheet accommodation section.

3. The sheet finisher of claim 2, wherein the controller controls the reversal conveying section such that the bundle having at least the top sheet and the succeeding sheet to the top sheet which are overlapped each other in the reversal conveying section, is conveyed-out from the reversal conveying section, and remaining sheets other than the top and the succeeding sheets of said second bundle and sheets of a preceding first bundle is conveyed-out one by one from the reversal conveying section.

4. The sheet finisher of claim 3, wherein the stopping member is set to either one of a first position at which a bottom end of a branching guide for branching the conveying-in section and the conveying-out section is positioned higher than an upper edge of a sheet when the sheet is stopped at the stopping member in the reversal conveying section, a second position at which the upper edge of the sheet stopped at the stopping member is positioned higher than the bottom end of the branching guide, thereby the sheet is directed toward the conveying-out section, and a third position at which the upper edge of the sheet stopped at the stopping member is held by the conveying-out section, wherein the controller controls the reversal conveying section such that the stopping member is lowered to be set to the first position when the top sheet of at least the second bundle of the sheet bundles to be stapled, then the stopping member is raised to be set to the second position, thereby the top sheet is directed toward the conveying-out section when the succeeding sheet to the top sheet of at least the second bundle is conveyed to the reversal conveying section, then the stopping member is lowered to be set again to the first position when the succeeding sheet is stopped by the stopping member, and then the stopping member is raised to be set to the third position, thereby the upper edges of the top and succeeding sheets are overlapped each other and simultaneously held by the conveying-out section.

5. The sheet finisher of claim 1, wherein the reversal conveying section is arranged in the vicinity of a sheet conveying-in inlet of the sheet finisher.

6. The sheet finisher of claim 1, wherein the stapler staples at edge or center position of the sheets.

7. The sheet finisher of claim 1, further comprising an alignment means for aligning the sheets.

8. The sheet finisher of claim 1, further comprising a folding section for folding the sheets.

9. An image forming apparatus comprising:

an image forming apparatus main body for forming an image on a sheet and conveying the sheet into a sheet finisher comprising:

(a) a stacker for stacking sheets conveyed-in one by one from an image forming apparatus;

(b) a stapler for stapling stacked sheets; and (c) a conveying timing adjustment section arranged upstream of the stacker comprising:

(1) a conveying-in section for conveying-in a sheet from the image forming apparatus;

(2) a conveying-out section separately provided from the conveying-in section for conveying-out the sheet;

(3) a reversal conveying section for reversing a conveying direction of the sheet conveyed in one direction from the conveying-in section and for conveying-out from the conveying-out section; and (4) a controller for controlling the reversal conveying section, wherein the controller controls the reversal conveying section such that at least a second bundle or a bundle after the second bundle of sheet bundles to be stapled by the stapler, in which a plurality of sheets having at least a top sheet and a succeeding sheet to the top sheet are overlapped each other, is conveyed-out from the reversal conveying section.

* * * * *